US006439000B1

(12) United States Patent
Smark

(10) Patent No.: US 6,439,000 B1
(45) Date of Patent: Aug. 27, 2002

(54) BEAD THREADING TOOL AND METHOD FOR CROCHETING, KNITTING AND THE LIKE

(76) Inventor: Anne A. Smark, 286 Liberty La., Melbourne Beach, FL (US) 32951

( * ) Notice: Subject to any disclaimer, the term of this patent is extended or adjusted under 35 U.S.C. 154(b) by 0 days.

(21) Appl. No.: 09/908,370

(22) Filed: Jul. 18, 2001

(51) Int. Cl.[7] ..... D04B 35/02; D05B 87/00
(52) U.S. Cl. ..... 66/1 A; 223/99
(58) Field of Search ..... 66/1 A, 3; 223/99, 223/106, 107, 108, 109; 112/225

(56) References Cited

U.S. PATENT DOCUMENTS

| | | | | | |
|---|---|---|---|---|---|
| 1,104,640 | A | | 7/1914 | Denner | |
| 1,144,504 | A | * | 6/1915 | Schneider | 223/99 |
| 2,567,408 | A | * | 9/1951 | Soderberg | 223/99 |
| 3,404,707 | A | * | 10/1968 | Feld | 223/99 |
| 4,102,478 | A | * | 7/1978 | Samilov | 223/99 |
| 4,667,860 | A | * | 5/1987 | Feuerman | 223/99 |
| 5,685,175 | A | | 11/1997 | Flavin et al. | |
| 5,881,738 | A | * | 3/1999 | Villani | 223/99 |

FOREIGN PATENT DOCUMENTS

| | | |
|---|---|---|
| FR | 780.672 | 4/1935 |

* cited by examiner

*Primary Examiner*—Danny Worrell
(74) *Attorney, Agent, or Firm*—Edward M. Livingston, Esq.

(57) ABSTRACT

A bead threading tool (4) formed by a folded wire having a distal end (6) formed by twisting the folded end of the wire, an intermediate section (5, 15) formed by the spaced apart folded over halves of the folded wire and a proximal end (8) formed by the tips of the folded wire fixably held by a holder (7) for holding the tool during use. During the crocheting or knitting process the tool (4) is used to add beads (2) to an article by placing the beads (2) onto the tool (4) by inserting the distal end (6) through the bead hole (14), inserting a pull-up loop (10) of the working thread (9) between wires of the intermediate section (5, 15), pulling the loop (10) toward the distal end (6) until it is hooked in the distal end, moving the beads (2) toward the distal end onto the loop (10), then removing the loop (10) from the tool by moving the loop from the distal end (6) into the intermediate section (5, 15) and completing the stitch to secure the bead (2) to a desired location of the article.

3 Claims, 2 Drawing Sheets

BEAD THREADING TOOL AND METHOD FOR CROCHETING, KNITTING AND THE LIKE

BACKGROUND OF THE INVENTION

This invention relates to the art of crocheting and knitting and more particularly to a tool for placing beads on an article which is being or has been crocheted or knitted.

The conventional method of securing a bead to a work being crocheted or knitted involves stringing a bead on a working thread using a needle and then the bead is removed from the string to place on the article being crocheted or knitted. This conventional method is time consuming and has many problems. For instance, the string holding the bead often becomes knotted which makes removing the beads difficult. Further, the beads are not securely fastened to the work after stitching because they are held only by a single thread. Thus, the beads can become detached easily or flop when the article is moved. Another problem is that the beads can only be placed in the location on the work only in the order the beads are placed on the working string and only at a particular location of the work. An additional problem is that the beads must be counted carefully when they are placed on the working string because more beads cannot be added unless the string is broken. If the string is broken and more beads added, however, the working thread must be tied, thereby leaving a knot in the working string. Also, the size of the beads that can be used with the conventional method are limited as some working strings makes it difficult to use tiny seed beads on the working string. An even further problem is that the beads can be placed on the work only during the crocheting or knitting process thereby making changes to the work after completion impossible.

Thus, a need exists for a bead threading tool and method that eliminates these problems.

The relevant prior art includes U.S. Pat. No. 1,104,640 issued to Denner on Jul. 21, 1914; U.S. Pat. No. 5,685,175 issued to Flavin, et al. on Nov. 11, 1997; and France Patent No. 780,672 issued to Burgard. However, none of these patents discloses a bead threading tool and method like the present invention.

SUMMARY OF THE INVENTION

The objects of the present invention are to provide a bead threading tool and method for use in crocheting, knitting and the like that:

- eliminates the need for a beaded working thread and the problems associated therewith;
- to enables the beads to be placed on the article not only during, but also after the article has been completed;
- allows the beads to be placed in any desired location on the article; and
- attaches beads to a work more securely than conventional methods.

The present invention offers the above and other objects by providing a bead threading tool made from a wire folded over and twisted at the fold to form a twisted distal end, an intermediate section formed by that portion of the folded wire and a proximal end formed by the tips of the folded over wire held fixably by a handle which may comprise a circular ball so the tool can be held during use. The method of using the bead threading tool for securing beads to an article during or after crocheting or knitting is also disclosed.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
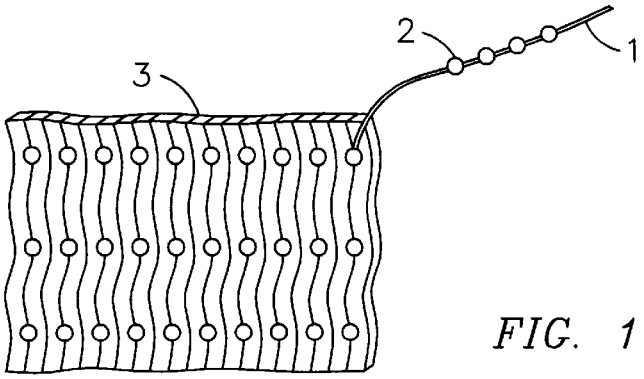
FIG. 1 is a perspective view of the conventional method of beading.

For purposes of describing the preferred embodiment, the terminology used in reference to the numbered components in the drawings is as follows:

| | | | |
|---|---|---|---|
| 1. | conventional working thread | 8. | proximal end of wire |
| 2. | beads | 9. | stitching thread |
| 3. | knitted article | 10. | pull-up loop |
| 4. | bead threading tool (the invention) | 11. | bead movement arrow |
| 5. | two wires of tool | 12. | tool pulling arrow |
| 6. | distal twisted end of tool | 13. | tool pushing arrow |
| 7. | holder | 14. | bead hole |
| | | 15. | intermediate section of tool |

The conventional method of applying beads to an article being crocheted can be explained briefly by reference to FIG. 1 which shows the work being crocheted as 3. Attached to the work 3 at a location is the conventional working thread 1. Beads 2 are placed on the working thread 1 by inserting an end of the thread 1 through a hole in the bead 2 using a needle. This conventional method of placing beads on an article requires that the beads be counted according to the number desired to be placed on the work 3 in the order in which they are going to appear on the work 3.

Figure 2:
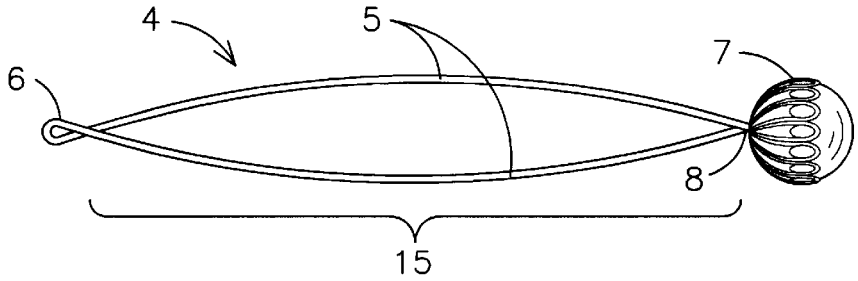
FIG. 2 is a side view of the bead threading tool of the present invention.

The bead threading tool 4 of the present invention shown in FIG. 2 eliminates the problems associated with the conventional beading method. The bead threading tool 4 is formed by folding in half one wire and twisting the folded end approximately 180° to form a twisted distal end 6 having an intermediate section 15 formed by the two folded halves of the folded wires 5. The proximal ends of the two wires 5 are held fixably to form a proximal end 8. The proximal end 8 may be held fixably by some type of handle for holding the tool during use. The handle may take the form of a circular ball 7 made of polypropylene or other rigid material.

Figure 3:
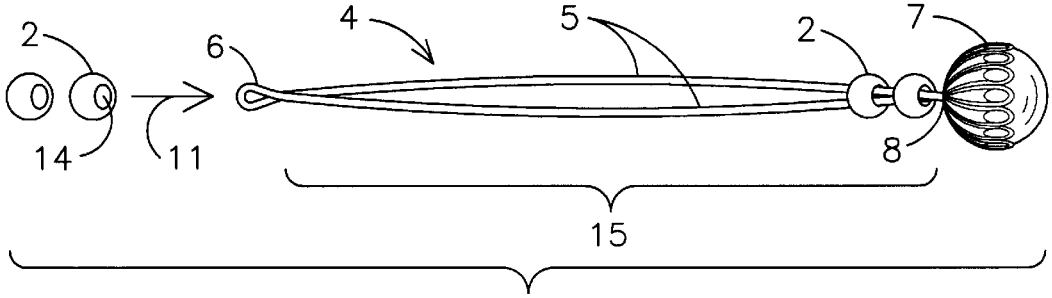
FIG. 3 is a side view of the bead threading tool of the present invention during the step of placing beads thereon.

The method of securing the beads to a work using the bead threading tool of the present invention can be described by reference to FIGS. 3–7. The step of placing the beads 2 on the tool 4 is shown in FIG. 3 whereby the bead 2 is placed on the tool by inserting the distal end 6 through the bead hole 14 and moving the bead 2 in the direction of the arrow 11 until the bead comes to rest at the proximal end 8 of the tool 4. A desired number of beads 2 may be placed on the tool 4 so the wires 5 of the intermediate section 15 remain sufficiently bowed or spaced apart for inserting the pull-up loop 10 of the working stitch 9 between the two wires 5 as shown in FIG. 4.

Figure 4:
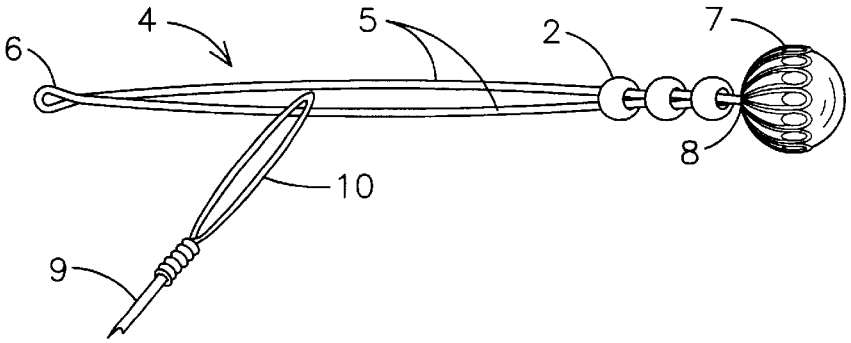
FIG. 4 is a side view of the bead threading tool of the present invention during the step of inserting the loop of the stitching thread between the wires of the tool.

FIG. 4 illustrates the step of securing the pull-up loop 10 of the working stitch by inserting it between the two wires 5.

Figure 5:
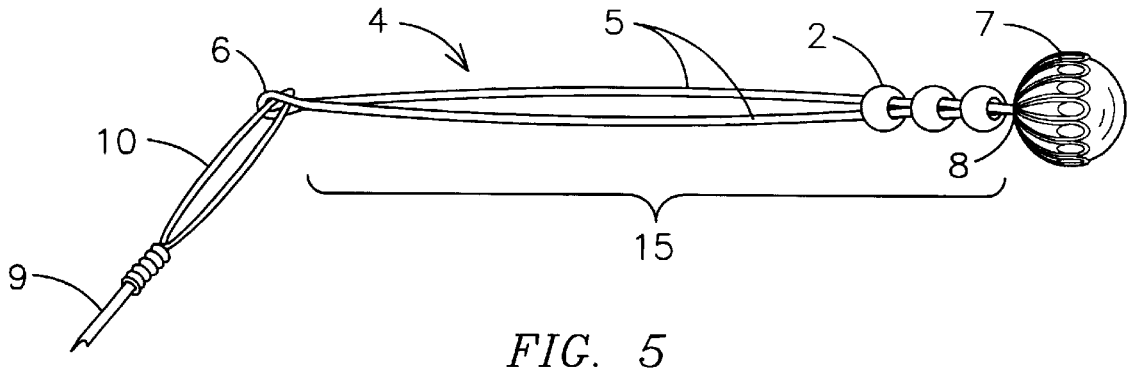
FIG. 5 is a side view of the bead threading tool of the present invention during the step of sliding the loop of the stitching thread into the distal end of the tool.

Then, as shown in FIG. 5, the loop is "lassoed" using the tool by inserting the loop 10 into the twisted distal end 6 until it is "hooked".

Figure 6:
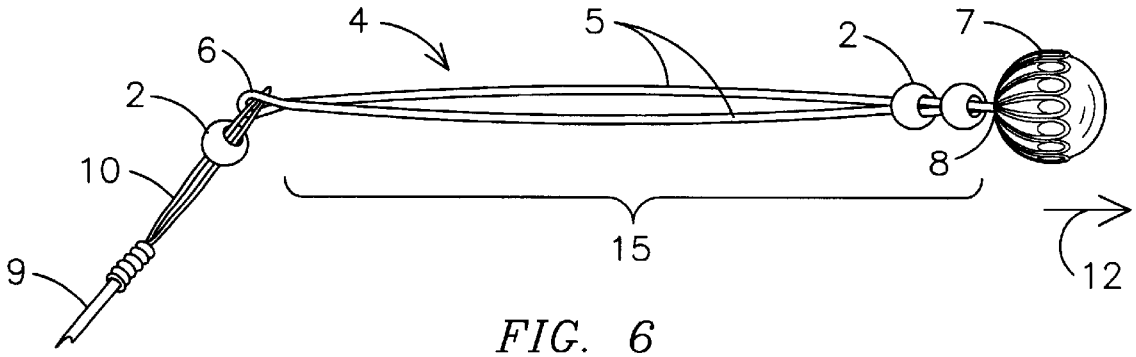
FIG. 6 is a side view of the bead threading tool of the present invention during the step of sliding the beads over the distal end and the loop of the stitching thread.

Next, as shown in FIG. 6, a bead 2 is placed onto the loop 10 by sliding the bead 2 toward the distal end 6 while pulling the tool using the handle 7 in the direction of the arrow 12.

Figure 7:
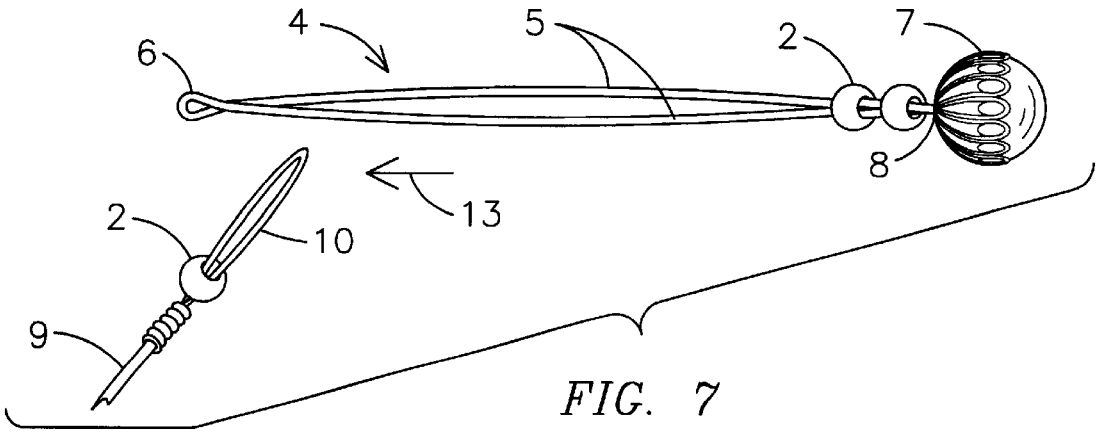
FIG. 7 is a side view of the bead threading tool of the present invention during the step of removing the loop of the stitching thread from the tool.

Finally, as illustrated in FIG. 7, the beaded loop 10 is removed from the tool 4 by sliding the loop 10 back toward the handle 7 while moving the tool 4 in the direction of the arrow 13 until the loop 10 is between the two wires 5 of the intermediate section 15 where the loop 10 is released so the bead 2 can be stitched using the double thread of the loop 10 to the article being crocheted or knitted.

As described, the bead threading tool of the present invention would be used to add beads to an article being made while crocheting or even after an article is completed, something which cannot be done with conventional beading methods. In the case where the tool is used to apply beads to a work that has already been crocheted, a "tambour" stitch wherein a "starting chain stitch," also known as a "slip stitch," forms a loop using the crochet hook. As described previously, that loop is locked in place on the work. Then the crochet hook is used to pull-up a loop at a location where a bead is desired and then using steps of the method described above the bead can be placed on the loop and secured by stitching it to the article.

Although only a few embodiments of the present invention have been described in detail hereinabove, all improvements and modifications to this invention within the scope or equivalents of the claims are included as part of this invention.

Having thus described my invention, I claim:

1. A method of using a bead threading tool for securing beads to an article made by crocheting, knitting or the like using a tool comprised of a folded wire having a distal end with a twist at a folded end, an intermediate section formed by overlapping half portion of the folded wire and a proximal end at the tips of the folded wire; and a handle having means for fixably holding the tips of the folded wire at the proximal end, said method comprising the steps of:

placing one or more beads on the tool by inserting the distal end of the tool into a hole in the beads and pushing said one or more beads toward the proximal end of the tool still leaving a space between the wires of the intermediate section of the tool;

inserting a pull-up loop of a working thread in the space between the wires of the intermediate section and sliding the loop toward the distal end until the loop becomes hooked in the twisted distal end of the fit tool;

moving a bead of said one or more beads from the proximal end of the tool toward and over the distal end until the bead is positioned on the loop;

removing the loop from the tool by pushing the tool in the direction of the loop so that loop slides from the twisted distal end into the intermediate section of the tool where it is released; and completing a stitch using the loop to secure the bead to a desired location on the article.

2. A bead threading, said tool comprising:

a folded wire having a distal end with a twist at an end of approximately 180° to form a loop, an intermediate section formed by an overlapping spaced-apart section of the folded wire and a proximal end at the tips of the folded wire; and a circular ball-like handle having means for fixably holding the tips of the folded wire at the proximal end.

3. The bead threading tool of claim 1 wherein the means for holding fixably the separated ends of the folded wire at the proximal end comprises an aperture into which the tips of the folded wire can be inserted and held in place.

* * * * *